US007017906B1

(12) United States Patent
Benjamin

(10) Patent No.: US 7,017,906 B1
(45) Date of Patent: Mar. 28, 2006

(54) MIRROR CHECKERS/CHESS

(76) Inventor: Gregory Benjamin, CFLCC-C4 Logistics Automation Bldg 5 APO AE 9366 (US)

( * ) Notice: Subject to any disclaimer, the term of this patent is extended or adjusted under 35 U.S.C. 154(b) by 26 days.

(21) Appl. No.: 10/786,123

(22) Filed: Feb. 26, 2004

(51) Int. Cl.
*A63F 3/00* (2006.01)

(52) U.S. Cl. ..... 273/260; 273/262

(58) Field of Classification Search ..... 273/260, 273/261, 255, 262
See application file for complete search history.

(56) References Cited

U.S. PATENT DOCUMENTS 1,472,657 A 10/1923 Lillard
3,353,829 A 11/1967 Board
3,779,554 A * 12/1973 Brix ..... 273/260
4,193,594 A * 3/1980 Schwauss ..... 273/441
5,171,018 A * 12/1992 Zhang ..... 273/260
5,957,455 A 9/1999 Aldridge
6,120,026 A 9/2000 Whitney et al.

* cited by examiner

*Primary Examiner*—Vishu K. Mendiratta
(74) *Attorney, Agent, or Firm*—Patent & Trademark Services, Inc.; Joseph H. McGlynn

(57) ABSTRACT

A board game such as checkers or chess in which one option would place mirrors so a player can only see his playing pieces in a mirror, while viewing his opponent's playing pieces directly. Another option would place mirrors so the player can only see his playing pieces directly while viewing his opponent's playing pieces in a mirror.

16 Claims, 2 Drawing Sheets

MIRROR CHECKERS/CHESS

BACKGROUND OF THE INVENTION

This invention relates, in general, to board games, and, in particular, to a board game which uses a mirror.

DESCRIPTION OF THE PRIOR ART

In the prior art various types of board games have been proposed. For example, U.S. Pat. No. 1,472,657 to Lillard discloses a chess game in which at least some of the pieces are covered with opaque covers.

U.S. Pat. No. 5,957,455 to Aldridge discloses a strategy game in which the playing positions are concealed requiring the players to resort to memorization of the positions of the playing pieces.

U.S. Pat. No. 3,353,829 to Board discloses a battleship type game in which the opponents position is concealed, but can be partially viewed with a viewing device.

U.S. Pat. No. 6,120,026 to Whitney et al discloses a game with a viewing screen that allows only a portion of the play region to be viewed.

SUMMARY OF THE INVENTION

The present invention is directed to a board game such as checkers or chess in which one option would place mirrors so a player can only see his playing pieces in a mirror, while viewing his opponent's playing pieces directly. Another option would place mirrors so the player can only see his playing pieces directly while viewing his opponent's playing pieces in a mirror.

It is an object of the present invention to provide a new and improved board game.

It is an object of the present invention to provide a new and improved board game in which the manner of playing can be adjusted to increase or decrease the difficulty in playing the game It is an object of the present invention to provide a new and improved board game which uses a mirror to increase or decrease the difficulty in playing the game.

These and other objects and advantages of the present invention will be fully apparent from the following description, when taken in connection with the annexed drawings.

DESCRIPTION OF THE PREFERRED EMBODIMENT

Figure 1:
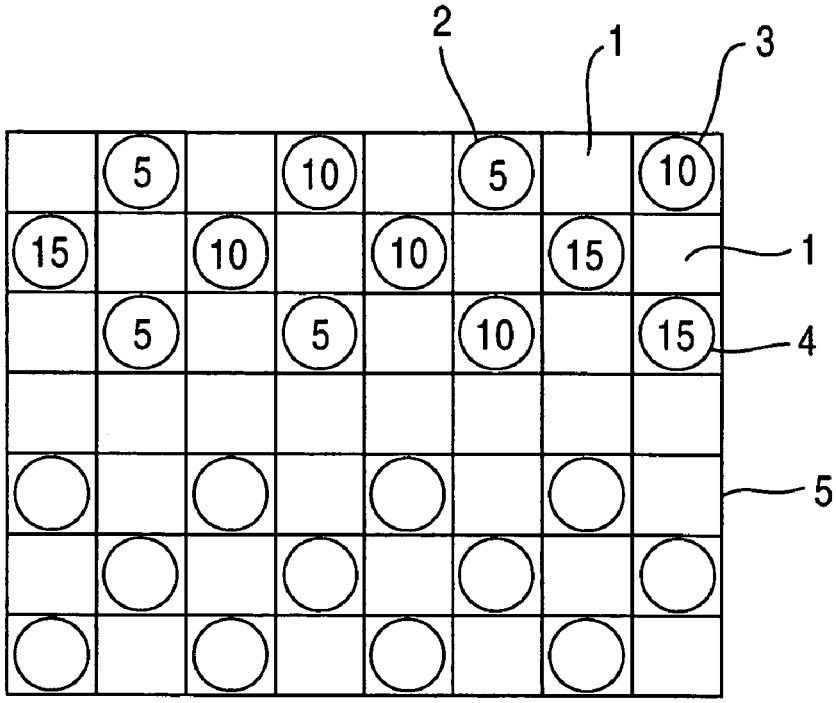
FIG. 1 is a top view of the board used with the present invention set up for checkers.

Referring now to the drawings in greater detail, FIG. 1 shows the game board 5 that will be used with the present invention. The board 5 is similar to a conventional checkers or chess board and has a plurality of squares 1 on the surface of the board. The squares 1 are arranged in the conventional checker-board fashion as shown in FIG. 1. Each player has 12 playing pieces 2, 3, 4. The playing pieces are arranged on three different rows, with four playing pieces on each row.

The playing pieces 2, 3, 4, shown in FIG. 1. are conventional shaped checker pieces except each piece will be marked in some fashion to distinguish one player's pieces from another player's pieces. For example, one player's pieces could be colored red and another's pieces could be blue. It should be noted that these colors are merely for illustration purposes and any color or combination of colors could be used without departing from the scope of the invention.

In addition, the playing pieces will be marked so some of the pieces are worth more points than other pieces. For example, some of the pieces could be marked with a "5", a "10" or a "15" as shown in FIG. 1. It should be noted that these numbers are merely for illustration purposes and any indicator could be used to distinguish the value of one playing piece from another without departing from the scope of the invention. For example, the pieces could be different colors or combinations of colors. That is one player's pieces could be colored yellow for "5", red for "10" and yellow and red for "15". Another player's pieces could be colored white for "5", blue for "10" and white and blue for "15". These colors are merely for illustrational purposes and can be changed to other colors or color combinations without departing from the scope of the invention.

The rules for moving the pieces 2, 3, 4 are similar, but not the same as, conventional checkers. The pieces are moved diagonally forward and each player moves one of the pieces alternately with another player. In order to capture an opponent's playing piece, the player must be able to jump the opponent's piece with his own piece. In order to jump a piece there must be a vacant space behind the opponent's piece. A player can jump as many of your opponent's pieces as possible on the same move if there are vacant spaces behind each opponent's playing piece. If a jump is available, the player must take it.

The goal of each player is to jump the opponent's playing piece with a playing piece of a lower value. The player cannot jump a checker piece of a higher value. The kings move the same way a queen moves in chess. Players take turns moving one piece at a time to weaken their opponents position and point total. Each player or team has four kings worth 15 points each, four pieces worth 10 points each, and four pieces worth 5 points each.

Figure 2:
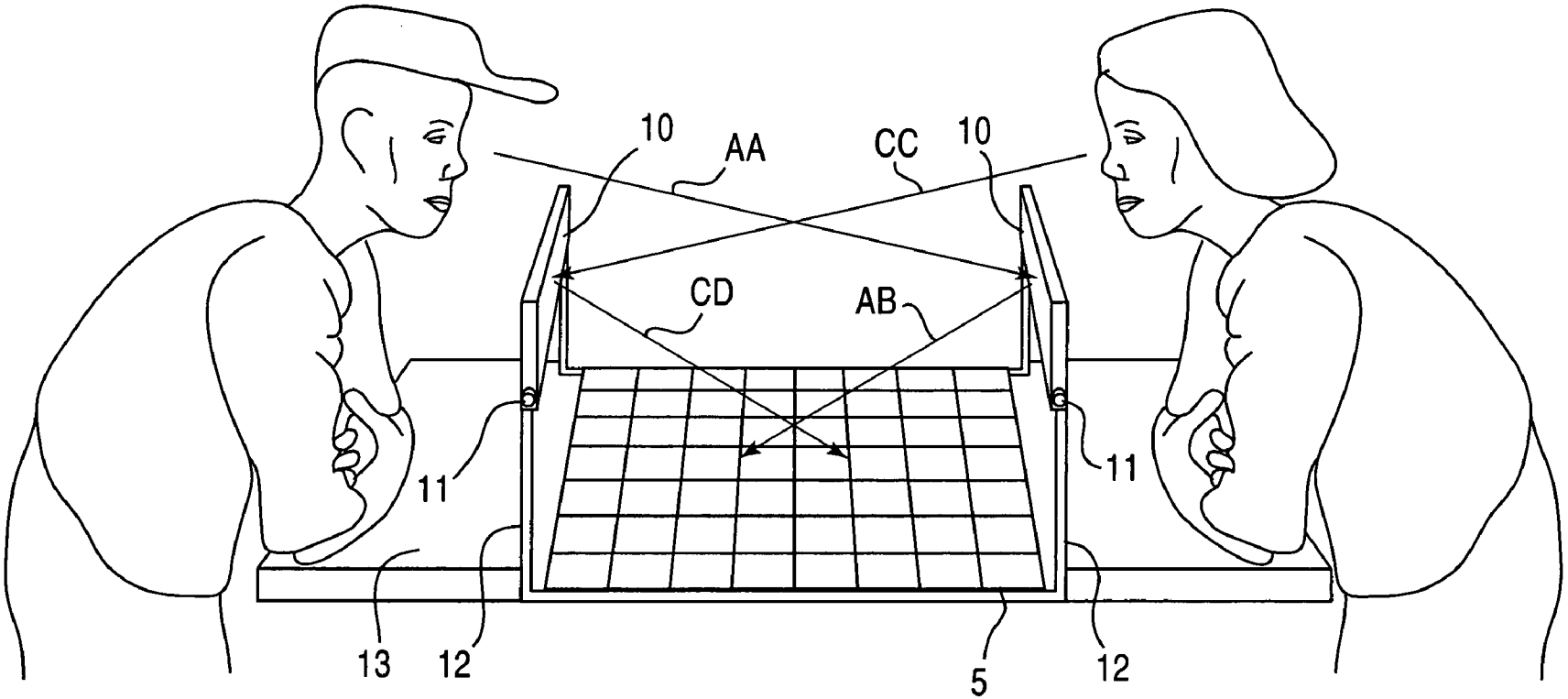
FIG. 2 is a perspective view of the board showing the line of sight permitted by mirrors for each player.

FIG. 2 shows the game board 5 (shown in FIG. 1) with mirrors 10 added to the board. It should be noted the playing pieces 2, 3 4, shown in FIG. 1, are not shown in FIG. 2 for clarity. The mirrors can be pivotally secured to legs 12 in any conventional manner, and the legs are secured to a support 13, again, in any conventional manner. Conventional control knobs 11 can be used to hold the mirrors 10 in any orientation selected by the players. The mirrors can be used to add different levels of difficulty to the game.

One option is to tilt the mirrors 10 so a player can only see his playing pieces in the mirror. This option is shown in FIG. 2 by the arrows, For example, the player on the left in FIG. 2 can only see the pieces on his side of the board 5 by looking into the mirror 10 on the opposite side of the board (see arrows AA and AB). The opponent on the right in FIG. 2 can only see the pieces on his side of the board 5 by looking into the mirror 10 on the opposite side of the board (see arrows CC and CD).

Figure 3:
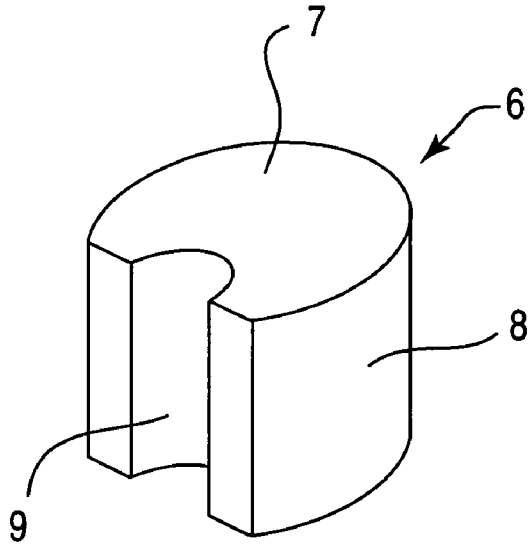
FIG. 3 is a perspective view of a cover for the playing pieces used with the present invention.

Another option is to place the playing pieces so the mirrors would be used to see only the opponent's playing pieces. In order to make these arrangements work, a plurality of covers 6 (only one of which is shown in FIG. 3) are used. Each cover has a top 7 and side 8. The side 8 only extends 270 degrees and has an opening 9 which will receive the playing pieces. By turning the covers 6, the playing piece can be made visible or not visible in the mirrors to the players.

The mirrors are designed so the entire board can not be seen at one time. The rules will allow a player a specified number of mirror moves in each game. For example, the rules could allow each player to adjust the mirror four times in a game. After a player exhausts his mirror moves he must leave the mirror in the last position. All of the above options are designed to add different levels of difficulty to the game.

Another option could be playing with four player in two teams. Player A on team 1 would sit directly across the board from player A on team 2, and Player B on team 1 would sit directly across the board from player B on team 2. Player A on team 1 would sit on the same side of the board as player B on team 2. In this manner the view of each player would be restricted by the mirror they are looking into. Team 1 players would have to ask team 2 players to move or not to move, and the team 2 players would answer "yes" or "no". Throughout the game each team must answer four questions correctly and five questions incorrectly. The player that is answering the question, "yes" or "no", must reveal to the opponent if it will help or hinder them. Neutral moves are considered as help or answering correctly.

Another game that can be played with the game board shown in FIG. 1 and the mirrors shown in FIG. 2 is chess. The conventional chess pieces are used and are arranged in the usual manner on the game board. Since the pieces and their arrangement is conventional they will not be illustrated. Again covers 6 are used to cover the chess pieces in order to hide their identity. Option 1, the chess pieces are arranged in the covers 6 so they face away from the player who owns them. That is, the opening 9 is turned away from the owning player so he can only see his pieces in the mirror. The player can see his opponent's pieces directly. Option 2, the chess pieces are arranged in the covers 6 so they face toward the player who owns them. That is, the opening 9 is turned so the owning player can see his pieces directly, and the player can only see his opponent's pieces in the mirror. The game is then played in the conventional manner.

Although the Mirror Checker/Chess and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A game comprising:

a board, said board having a playing surface, said playing surface being divided into a plurality of squares, a plurality of playing pieces, means for identifying one player's playing pieces from another player's playing pieces, means for assigning different values to each player's playing pieces, means for restricting each player's view of the game board throughout the game, and wherein said means for restricting each player's view of the game board is a mirror and wherein there are two mirrors, each mirror mounted on a stand above the game surface on each side of the game board.

2. The game as claimed in claim 1, wherein said means for identifying one player's playing pieces from another player's playing pieces is different colors.

3. The game as claimed in claim 1, wherein said means for identifying one player's playing pieces from another player's playing pieces is different combinations of colors.

4. The game as claimed in claim 1, wherein said means for assigning different values to each player's playing pieces are number which are assigned to each playing piece.

5. The game as claimed in claim 4, wherein some of the playing pieces are assigned a first value and some of the playing pieces are assigned a second value, and wherein said first value is different than said second value.

6. The game as claimed in claim 4, wherein the playing pieces are assigned three different values, some of the playing pieces are assigned a first value, some of the playing pieces are assigned a second value which is higher than said first value, and some of the playing pieces are assigned a third value which is higher than said first and second value.

7. The game as claimed in claim 1, wherein one of said two mirrors allows a player to view only his own playing pieces in said one of said two mirrors.

8. The game as claimed in claim 1, wherein one of said two mirrors allows a player to view only his opponent's playing pieces in said one of said two mirrors.

9. A game comprising:

a board, said board having a playing surface, said playing surface being divided into a plurality of squares, a plurality of playing pieces, means for identifying one player's playing pieces from another player's playing pieces, means for assigning different values to each player's playing pieces, means for restricting each player's view of the game board, and wherein said means for restricting each player's view of the game board is a mirror, and wherein there are two mirrors, one on each side of said game board, and wherein each of said two mirrors are attached to stands above the game board surface, and said stands have means for allowing each of said two mirrors to be adjusted.

10. The game as claimed in claim 9, wherein said means for identifying one player's playing pieces from another player's playing pieces is different colors.

11. The game as claimed in claim 9, wherein said means for identifying one player's playing pieces from another player's playing pieces is different combinations of colors.

12. The game as claimed in claim 9, wherein said means for assigning different values to each player's playing pieces are number which are assigned to each playing piece.

13. The game as claimed in claim 12, wherein some of the playing pieces are assigned a first value and some of the playing pieces are assigned a second value, and wherein said first value is different than said second value.

14. The game as claimed in claim 12, wherein the playing pieces are assigned three different values, some of the playing pieces are assigned a first value, some of the playing pieces are assigned a second value which is higher than said first value, and some of the playing pieces are assigned a third value which is higher than said first and second value.

15. The game as claimed in claim 9, wherein one of said two mirrors allows a player to view only his own playing pieces in said one of said two mirrors.

16. The game as claimed in claim 9, wherein one of said two mirrors allows a player to view only his opponent's playing pieces in said one of said two mirrors.

* * * * *